United States Patent [19]

Huppert et al.

[11] 4,129,518

[45] Dec. 12, 1978

[54] METHOD FOR CONDITIONING METALLIC WASTE SHELLS MADE OF ZIRCONIUM OR ZIRCONIUM ALLOYS

[75] Inventors: Karl-Ludwig Huppert, Neuthard; Dieter Fang, Karlsruhe, both of Fed. Rep. of Germany

[73] Assignee: Gesellschaft zur Wiederaufarbeitung von Kernbrennstoffen mbH, Eggenstein-Leopoldshafen, Fed. Rep. of Germany

[21] Appl. No.: 782,088

[22] Filed: Mar. 28, 1977

[30] Foreign Application Priority Data

Mar. 30, 1976 [DE] Fed. Rep. of Germany ..... 2613537

[51] Int. Cl.[2] ..... G21F 9/30

[52] U.S. Cl. ..... 252/301.1 W; 423/2; 423/249

[58] Field of Search ..... 252/301.1 W; 423/2, 423/4, 249

[56] References Cited

U.S. PATENT DOCUMENTS

| | | | |
|---|---|---|---|
| 3,012,385 | 12/1961 | Hufft | 252/301.1 W |
| 3,294,492 | 12/1966 | Bartlett et al. | 423/4 |
| 3,779,938 | 12/1973 | Weakley | 252/301.1 W |

FOREIGN PATENT DOCUMENTS

| | | | |
|---|---|---|---|
| 1520681 | 4/1968 | France | 252/301.1 W |
| 997355 | 7/1965 | United Kingdom | 423/4 |

OTHER PUBLICATIONS

Haeffner E. et al., "A Reprocessing Alternative for Zircaloy . . . Elements," Proceedings of the Third International Conference on the Peaceful Uses of Atomic Energy, Geneva, 1964, vol. 10, pp. 370–379.
Chem. Abstracts 79:96687j.

*Primary Examiner*—Benjamin R. Padgett
*Assistant Examiner*—Deborah L. Kyle
*Attorney, Agent, or Firm*—Spencer & Kaye

[57] ABSTRACT

Method for conditioning metallic waste shells of zirconium or zirconium alloys obtained during processing of irradiated nuclear reactor fuel elements for noncontaminating final storage. The waste shells are subjected to a controlled oxidation at increased temperature to produce noncombustible, stable waste products which consist substantially of zirconium dioxide. The noncombustible, stable waste products so-produced are brought to final storage.

13 Claims, No Drawings

METHOD FOR CONDITIONING METALLIC WASTE SHELLS MADE OF ZIRCONIUM OR ZIRCONIUM ALLOYS

BACKGROUND OF THE INVENTION

The present invention relates to a method for conditioning metallic waste shells made of zirconium or zirconium alloys from the processing of irradiated nuclear reactor fuel elements for noncontaminating final storage.

The fuel elements of nuclear reactors in the majority of cases consist of the actual nuclear fuel and a metallic protective shell which, for use in so-called "thermal" reactors, is usually made of zirconium or a zirconium alloy. The nuclear fuel itself may be uranium oxide, plutonium oxide, thorium oxide, mixtures of these substances, or uranium and plutonium metal.

In the known reprocessing of fuel elements, the fuel elements, either as a whole or after separation of the fuel rods, are mechanically comminuted by means of scissors or shredders according to the almost exclusively employed decomposition process. In a subsequent process step, the metallic or oxidic nuclear fuel is then removed from the shell sections by means of an acid whereby the shredded metallic shell sections remain undissolved. The undissolved shredded metallic shell sections are washed and treated as metallic shell wastes.

The shell waste, consisting essentially of zirconium or a zirconium alloy, is normally radioactive due to neutron activation and contains radioactive fission products and actinides as contaminants. The shell waste must therefore be handled by remote control, according to the known principles for handling substances emitting radioactive and penetrating radiation.

A particular problem in the handling of these metallic shell wastes is the capability of zirconium, and its alloys, to react with oxygen and, at increased temperature, also with the nitrogen of the air, with the development of fire. Fires of radioactive zirconium wastes have been known to occur on several occasions. In addition to the usual undesirable effects of a metal fire, the fire may result in uncontrolled release of radioactivity. In reprocessing systems in which such shell wastes are routinely handled, special measures must be taken to accommodate this potential source of danger. One of these measures which has been used is the treating and storing of shell waste under water. With this method, continuous monitoring of the storage facility and of the water level is necessary and unavoidable. Further, there exists the latent danger of escape of contaminated water into uncontrolled regions. This process is therefore not suitable for permanent storage.

Another known process for conditioning the zirconium containing waste shells is to fix them in a special cement slurry so that a solid block of metal concrete is obtained. Objections have been raised against this process, inasmuch as, depending on the type of shells involved, "gassing" of the concrete has sometimes been noted, which may possibly adversely influence the stability of the bond.

SUMMARY OF THE INVENTION

It is therefore an object of the present invention to provide an improved method which avoids the drawbacks of the known procedures for conditioning of metallic waste shells of zirconium or zirconium alloys.

A further object of the present invention is to provide such a method which permits handling and conditioning of the waste shells without danger and results in a product (waste product) which is suitable for permanent storage.

Additional objects and advantages of the present invention will be set forth in part in the description which follows and in part will be obvious from the description or can be learned by practice of the invention. The objects and advantages are achieved by means of the methods, processes, instrumentalities and combinations particularly pointed out in the appended claims.

To achieve the foregoing objects and in accordance with its purpose, as embodied and broadly described, the present invention provides a method for conditioning metallic waste shells of zirconium or zirconium alloys obtained during processing of irradiated nuclear reactor fuel elements for noncontaminating final storage, comprising subjecting the waste shells to a controlled oxidation at increased temperature in a reaction furnace to produce a noncombustible, stable waste product which consists essentially of zirconium dioxide, and bringing the noncombustible waste product so-produced to final storage.

The noncombustible waste products produced in accordance with the present invention can be brought to final storage as such or can be incorporated in a solidification matrix. In one embodiment of the invention, the waste product is solidified by adding cement in amounts from one-quarter to one-seventh of its volume and water. In another embodiment of the invention, the waste product is mixed with molten bitumen and then solidified.

Preferably, the oxidation is effected at temperatures between about 800° C and about 1500° C and an oxygen containing gas is introduced into the reaction furnace for the oxidation process. It is further preferred to effect the oxidation in an electrically-heated shaft furnace or in an electrically-heated rotary drum furnace. The furnaces in which the oxidation reactions take place preferably are provided with inserts which permit further transport only of oxidized material.

Preferably, part of the already-oxidized material always remains in the reaction furnace and moderates the conversion of newly-introduced pieces of metallic waste shells.

DETAILED DESCRIPTION OF THE INVENTION

In the practice of the present invention, metallic waste shells of zirconium or zirconium alloys are subjected to a controlled oxidation at high temperature in a reaction furnace. The oxidation of the waste shells is effected at temperatures between 800° C and 1500° C and an oxygen containing gas, for example, air, pure oxygen or a mixture of air and oxygen, is introduced into the reaction furnace for this purpose. The reaction can be controlled without special measures so that the formation of the oxide takes place promptly and without the development of smoke.

With "controlled oxidation" is meant an increase by steps of the furnace temperature with 100° C per 15 minutes. The range for the amount of oxygen containing gas per weight of waste shells 50 – 100-fold of the stoichiometric amount. The range for the time period of the oxidation is 6 – 12 hours. The reaction takes place at normal pressure.

The oxidation is advantageously effected in a well known electrically-heated shaft furnace or, likewise, in a well known electrically-heated rotary drum furnace. The furnaces in which the oxidation reaction takes place preferably are provided with inserts which permit further transporting through the furnace of only the oxidized material.

The end of waste product of the process of the present invention is a whitish, granular mass of highly annealed zirconium oxide in mixture with other oxides, such as iron III oxide and tin IV oxide which originate from the alloy components. It can be an inert, particulate or powdery material. The end product is insoluble in water, diluted acids and liquors as well as organic solvents. The amphoteric or acid character of the zirconium oxide that is formed has the result that the more-easily volatile oxides, such as lithium or cesium oxide, will not escape during the reaction, but are bound in the waste product in the form of zirconates or mixed oxides, respectively.

In the practice of the novel process of the present invention, there is a realizable reduction in volume to about 50% of the metallic starting material, that is, the volume of the waste product generally is about 50% of the volume of the metallic starting material. Due to its granular consistency, the reaction product can be removed very easly from the reaction furnace by a well known air lifter *. This is of particular advantage when shaft or crucible furnaces are employed.

*which works similarly as an installation for transporting corn into a silo. With the air lifter the granular powder is sucked off and sent to the solidification plant.

Electrically-heated rotary drum furnaces which permit slow moving of the material are particularly well suited for effecting the above-described reaction. By means of disc-shaped inserts, the movement of the material can be controlled so that only the smaller particles travel to the discharge end of the furnace and are thus completely oxidized through. The always-present fill of part of a finer-grained, already-oxidized, powdery material, which remains in the reaction furnace and moderates the conversion of the newly filled-in metal pieces, protects the newly-introduced shells from too strong a reaction.

The waste product, which substantially and essentially consists of zirconium dioxide, is already suitable for final storage in the resulting annealed form, that is, it can be placed in permanent storage directly as it comes from the reaction furnace without any further processing. For this purpose, the waste product is preferably filled into steel drums which are tightly sealed and stored. For example, it is possible to accommodate the processed waste shells from 2 to 14 reactor fuel elements in a 200 liter standard ton "Straimer" drum. Alternatively, the waste product can also be solidified into a concrete-like substance by means of a binder, such as, for example, a cement adhesive with a quantity of cement which corresponds to a quantity between one-fourth and one-seventh of the volume of the waste product or by mixing the waste product with molten bitumen. The resulting solidified mass is then suitable for final and permanent storage. Compared to the conventional methods for conditioning the waste shells, the process according to the present invention provides a stable, decay-free form for storage for which safety monitoring during storage is not required.

The following example is given by way of illustration to further explain the principles of the invention. This example is merely illustrative and is not to be understood as limiting the scope and underlying principles of the invention in any way. All percentages referred to herein are by weight unless otherwise indicated.

EXAMPLE

In this example, 400 milliliters, corresponding to 405 g, of piled zirconium-containing shell material were heated in an electrical furnace to 1000° C. A small quantity of air was blown in, for instance a fifty-fold surplus according to the stoichiometric amount needed. The oxidation of the metal proceeded slowly and was complete after about 6 hours. Glowing occurred only at the burrs of the chopped shell material. Smoke or gaseous reaction products were not observed. During the reaction, the metallic shells expanded and disintegrated into a whitish reaction product. Upon completion of the process, the reaction product had only a volume of 200 milliliters or 50% of the starting volume. Its weight was about 540 g. During the oxidation process, there was a slight advantageous moving of the mass which resulted in peeling off of the already oxidized layers of the shells. Through the moving of the shell material in a rotating furnace — for instance a furnace usual in the cement production — the already oxidized layers of the shells are peeled off and grinded. The inserts have small holes through which the granular powder can flow.

It will be understood that the above description of the present invention is susceptible to various modifications, changes and adaptations, and the same are intended to be comprehended within the meaning and range of equivalents of the appended claims.

What is claimed is:

1. Method for conditioning metallic waste shells of zirconium or zirconium alloys obtained during processing of irradiated nuclear reactor fuel elements for non-contaminating final storage, comprising subjecting the waste shells to a controlled oxidation at increased temperature in a reaction furnace to produce noncombustible, stable waste products which consist essentially of zirconium dioxide, and bringing the noncombustible waste products so-produced to final storage.

2. Method as defined in claim 1, wherein the oxidation is effected at temperatures between about 800° C and about 1500° C.

3. Method as defined in claim 1, wherein the oxidation is effected by introducing an oxygen containing gas into the reaction furnace.

4. Method as defined in claim 1, wherein the oxidation is effected in an electrically-heated shaft furnace.

5. Method as defined in claim 1, wherein the oxidation is effected in a electrically-heated rotary drum furnace.

6. Method as defined in claim 4, wherein the oxidation reaction takes place in a furnace which is provided with inserts which permit further transport only of oxidized material.

7. Method as defined in claim 1, wherein a portion of the already-oxidized material always remains in the reaction furnace and moderates the conversion of newly-introduced pieces of metallic waste shells.

8. Method as defined in claim 1, wherein the waste product is brought directly to final storage in the same form that it leaves the furnace.

9. Method as defined in claim 1, wherein the waste product is solidified in a solidification matrix and the solidified waste product is brought to final storage.

10. Method as defined in claim 9, wherein the waste product is solidified by adding cement in amounts from one-quarter to one-seventh of its volume and water.

11. Method as defined in claim 9, wherein the waste product is solidified by mixing with molten bitumen.

12. Method as defined in claim 1 wherein the oxidation is effected with an oxygen containing gas in an amount per weight of waste shells of 50 to 100 times the stoichiometric amount, the furnace temperature is between about 800° C and about 1500° C and is achieved by temperature increases in steps of 100° C per 15 minutes, and the time period of the oxidation is 6 to 12 hours.

13. Method as defined in claim 1 wherein the metallic waste shells are shell sections from which nuclear fuel has been removed.

* * * * *